US006017233A

United States Patent [19]

Fry et al.

[11] Patent Number: 6,017,233

[45] Date of Patent: Jan. 25, 2000

[54] FLOATING PANEL MOUNT SYSTEM FOR ELECTRICAL CONNECTORS

[75] Inventors: Rupert J. Fry, Des Plaines; Gary E. Polgar, Bolingbrook, both of Ill.

[73] Assignee: Molex Incorporated, Lisle, Ill.

[21] Appl. No.: 08/355,586

[22] Filed: Dec. 14, 1994

[51] Int. Cl.[7] ..... H01R 13/64

[52] U.S. Cl. ..... 439/248; 439/552

[58] Field of Search ..... 439/248, 247, 439/557, 533, 552, 555

[56] References Cited

U.S. PATENT DOCUMENTS

| | | | |
|---|---|---|---|
| Re. 34,430 | 11/1993 | Mosquera et al. | 439/248 |
| 4,220,808 | 9/1980 | Fujita | 174/48 |
| 4,340,795 | 7/1982 | Arthur | 200/295 |
| 4,812,133 | 3/1989 | Fleak et al. | 439/248 |
| 4,990,094 | 2/1991 | Chandler et al. | 439/557 |
| 5,238,426 | 8/1993 | Arnett | 439/557 |

*Primary Examiner*—David L. Pirlot
*Assistant Examiner*—Brian J. Biggi
*Attorney, Agent, or Firm*—Stephen Z. Weiss

[57] ABSTRACT

A floating panel mount system is disclosed for mounting an electrical connector to a panel. The system includes a panel having an aperture arrangement therethrough. A connector housing has a mating portion adapted to pass through the aperture arrangement from one side of the panel for mating with a complementary connecting device on the opposite side of the panel and adapted to provide substantial clearance in the aperture arrangement permitting floating motion relative to the panel. A locking portion of the connector housing is adapted to pass through the aperture arrangement from the one side of the panel and adapted to provide substantial clearance in the aperture arrangement. A flange portion of the connector housing is adapted to engage the one side of the panel laterally of the aperture arrangement. A retaining cap lockingly interengages with the locking portion and is engageable with the opposite side o the panel to prevent the mating portion from pulling back out of the aperture arrangement.

17 Claims, 6 Drawing Sheets

FLOATING PANEL MOUNT SYSTEM FOR ELECTRICAL CONNECTORS

FIELD OF THE INVENTION

This invention generally relates to the art of electrical connectors and, particularly, to a floating panel mount system for mounting an electrical connector to a panel.

BACKGROUND OF THE INVENTION

Electrical connectors comprise opposed mateable male and female electrical connector halves, each of which comprises a housing and at least one electrical terminal securely mounted therein. Electrical conductors or wire leads are joined to the terminals mounted in the housings, and may further be mechanically joined to the housing itself to achieve a strain relief connection. The housing of at least one half of the electrical connector typically may be mounted to a panel. Many connectors, such as drawer connectors, include a pair of panel mounted connector halves which are mateable with one another by movement of at least one of the panels toward the other.

The housings may be molded from a suitable dielectric plastic material, and preferably define a unitary molded plastic structure. The opposed mateable connector housings typically include appropriate guide structures for guiding the two mateable connector halves into a mated electrical connection. To facilitate this initial mechanical alignment of the connector housings, at least one connector half, and typically the male connector half, is provided with a floating mount to the panel.

Prior art floating panel connectors have mounting means extending from the connector housing in the form of flexible locking arms which lock directly to the panel. These arms have had problems of breaking while not being able to provide a large lateral floating movement between the connector housing and the panel. The present invention is directed to providing a floating panel mount system which allows the use of considerably larger or at least more robust locking arms than have heretofore been available, yet providing a substantial range of lateral floating movement between the connector housing and the panel. Such a substantial range of lateral movement is necessary in a "blind mating" condition where the connectors are not visible to the person or machine causing the mating.

SUMMARY OF THE INVENTION

An object, therefore, of the invention is to provide a new and improved floating panel mount system for mounting electrical connectors to panels.

In the exemplary embodiment of the invention, the system includes a panel having aperture means therethrough. A connector housing has a mating portion adapted to pass through the aperture means from one side of the panel for mating with a complementary connecting device on the opposite side of the panel and adapted to provide substantial clearance in the aperture means permitting floating motion relative to the panel. The housing has a locking portion adapted to pass through the aperture means from the one side of the panel and adapted to provide substantial clearance in the aperture means. The housing further has a flange portion adapted to engage the one side of the panel laterally of the aperture means. A retaining cap is lockingly interengageable with the locking portion and is engageable with the opposite side of the panel to prevent the mating portion from pulling back out of the aperture means.

In the preferred embodiments of the invention, the housing, including the mating portion, the locking portion and the flange portion thereof, is unitarily molded of dielectric material. The retaining cap is an independent or separate member lockingly interengageable with the locking portion.

In one embodiment of the invention, the aperture means is provided by at least one aperture for passing therethrough of the mating portion and second aperture for passing therethrough of the locking portion. Preferably, a pair of the locking portions are disposed generally on diametrically opposite sides of the mating portion. A pair of the second apertures are provided for passing therethrough of the pair of locking portions, and a pair of the retaining caps are provided for locking interengagement with the pair of locking portions.

In another embodiment of the invention, the aperture means is provided by a single aperture for passing therethrough of both the mating portion and the locking portion. Preferably, a pair of the locking portions are provided generally on diametrically opposite sides of the mating portion, and both locking portions as well as the mating portion are adapted for passing through the single aperture.

As disclosed herein, the locking portion or portions are provided by a flexible locking arm having a hook portion for locking interengagement with the retaining cap. The retaining cap has a hole into which the locking arm snappingly interengages by means of the hook portion.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 8:
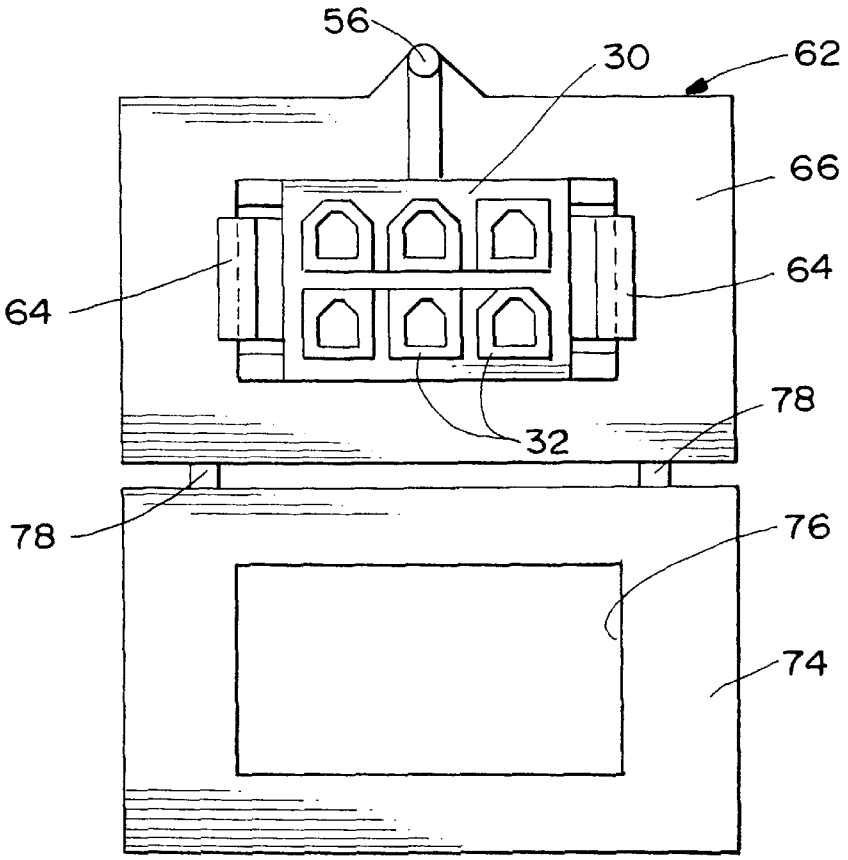
FIG. 8 is a view similar to that of FIG. 6, but of a second embodiment of the invention.
Figure 9:
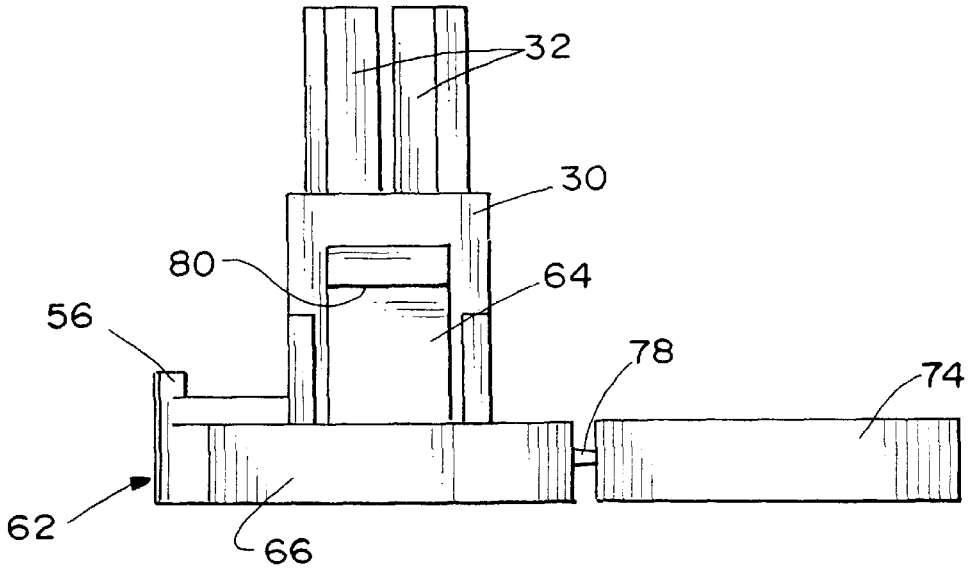
FIG. 9 is an end elevational view looking toward the left-hand end of FIG. 8.
Figure 10:
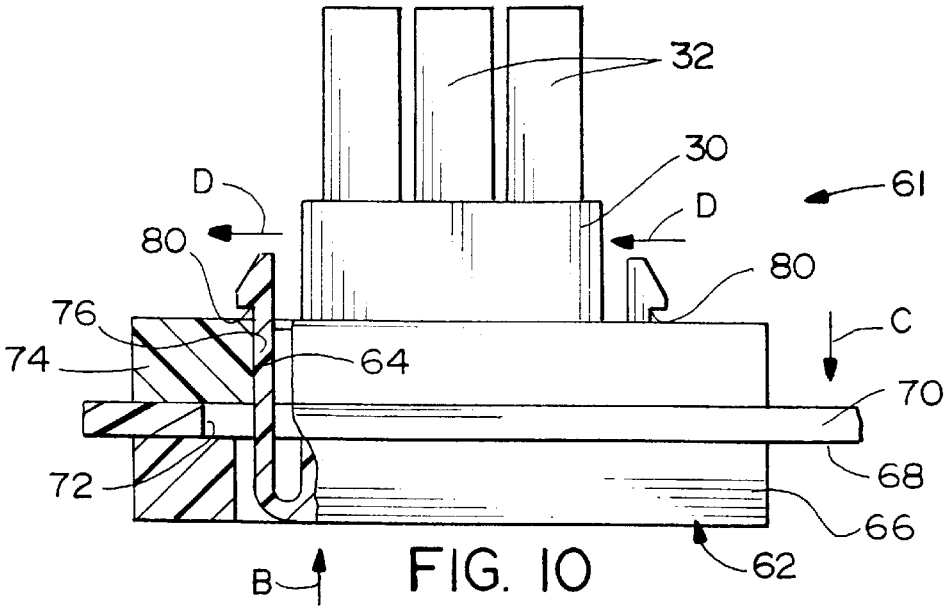
FIG. 10 is a partially cut-away front elevational view of the embodiment of FIGS. 8 and 9 fully mounted in a panel.
Figure 12:
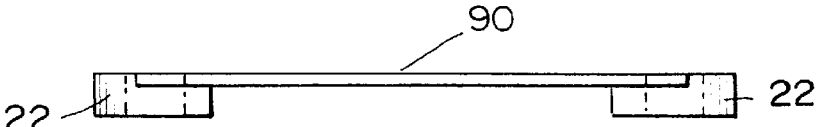
FIG. 12 is a side elevational view looking toward the top of FIG. 11.
Figure 13:
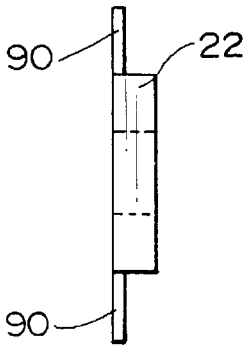
FIG. 13 is an end elevational view looking toward the left-hand end of FIG. 11.
Figure 11:
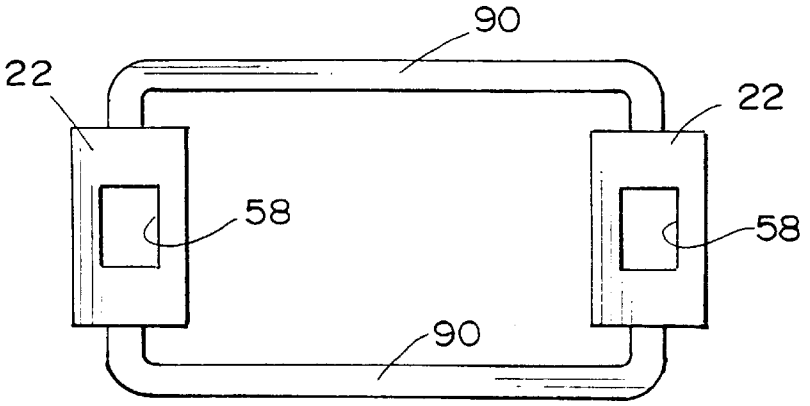
FIG. 11 is a plan view of an integral component having two retaining caps joined together.

Referring to the drawings in greater detail, FIGS. 1–7 show a first embodiment of the invention; FIGS. 8–10 show a second embodiment of the invention; and FIGS. 11–13 show a form of integrally joining the retaining caps for use with the embodiment of FIGS. 1–7.

Figure 1:
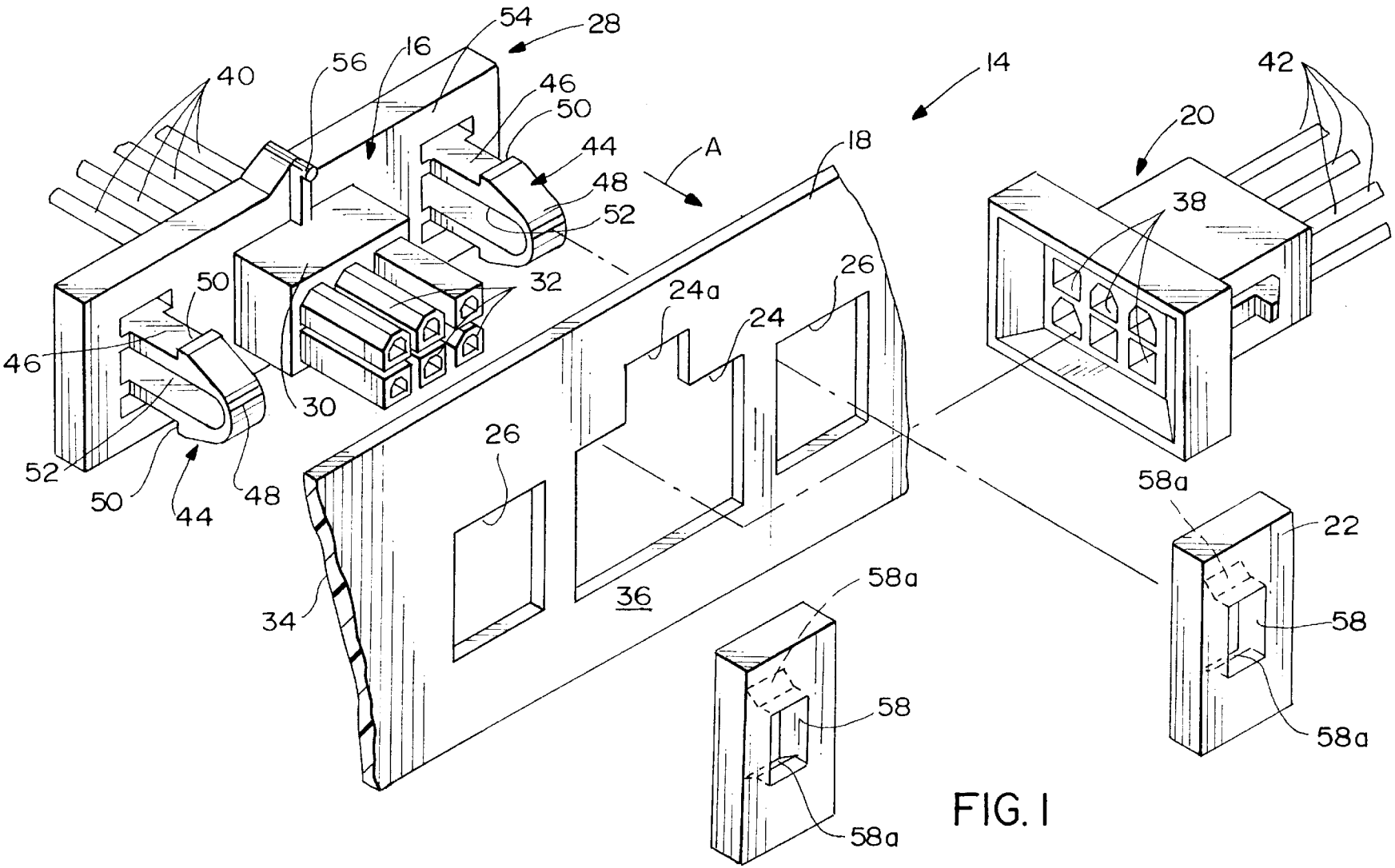
FIG. 1 is an exploded perspective view of a panel mount electrical connector assembly incorporating one embodiment of the floating panel mount system of the invention.
Figure 2:
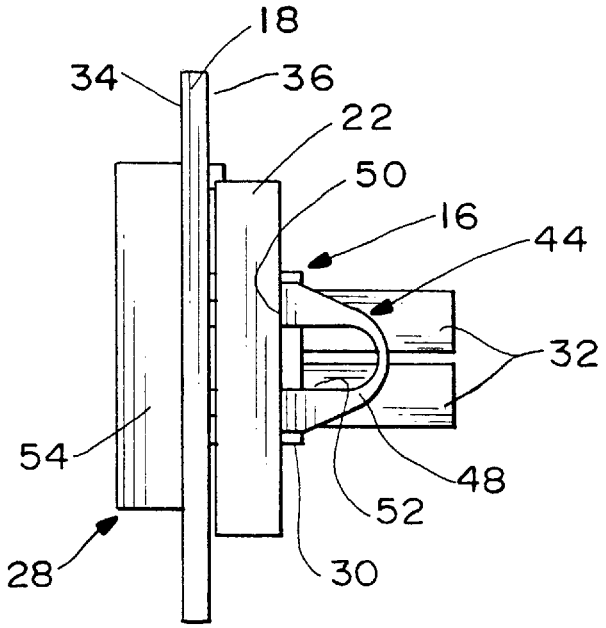
FIG. 2 is an end elevational view of the connector assembly of FIG. 1 mounted to the panel.

More particularly, referring to FIG. 1 in greater detail, a floating panel mount system, generally designated 14, is disclosed for mounting an electrical connector, generally designated 16, to a panel 18. The connector is mateable through the panel with a complementary connector or other connecting device, generally designated 20. As will be described in greater detail hereinafter, the floating panel mount system employs a pair of retaining caps 22 for locking the connector to or through the panel to prevent the connector from pulling back out of the panel and to permit substantial floating motion relative to the panel.

More particularly, panel 18 includes aperture means therethrough which, in the embodiment of FIGS. 1–7, includes a first, center aperture 24 and a pair of second, outside apertures 26 generally diametrically on opposite sides of center aperture 24. Center aperture 24 is larger than outside apertures 26, and center aperture 24 includes a notch portion 24*a* for purposes to be described hereinafter.

Electrical connector 16 actually is part of a larger, unitarily molded dielectric housing, generally designated 28. The housing has a mating portion 30, including silos 32, adapted to pass through aperture 24 from a back side 34 of panel 18 for mating with complementary connecting device 20 on the opposite side 36 of the panel. Connecting device 20 includes a plurality of through passages 38 for receiving silos 32 of connector 16. Although not visible in the drawings, connector 16 has terminals therewithin which are terminated to electrical cables 40, and connecting device 20 has terminals therein which are terminated to electrical cables 42. As will be described hereinafter, center aperture 24 is substantially larger than mating portion 30 to provide substantial clearance in the aperture permitting floating motion of the connector, as well as the entire housing 28, relative to panel 18.

Connector housing 28 further has a pair of locking portions, generally designated 44, adapted to pass through outside apertures 26 from back side 34 of panel 18. Each locking portion 44 is provided by a flexible locking arm structure having a neck 46, a head 48 and a transversely projecting hook portion 50 therebetween. Each flexible locking arm is split lengthwise, as at 52, to provide considerable flexibility and yielding of the arm.

Lastly, unitarily molded connector housing 28 has a flange portion 54 which is adapted to engage back side 34 of panel 18 laterally about apertures 24 and 26 once mating portion 30 is inserted through center aperture 24 and locking arms 44 are inserted through outside apertures 26. A fulcrum pin 56 projects forwardly of flange 54 and becomes located within notch portion 24*a* of aperture 24.

Floating panel mount system 14 lastly includes the aforementioned retaining caps 22 which are lockingly interengageable with locking arms 44 after the arms pass through outside apertures 26. The retaining caps also are adapted to be engageable with front side 36 of panel 18 to prevent the entire connector housing 28 and its various components from backing out of the apertures in the panel. Each retaining cap 22 includes a hole 58 for passing therethrough of one of the flexible locking arms 44. The hole is chamfered, as at 58*a*, to guide the locking arm into the hole and facilitate compression of the arm, as described below.

More particularly, holes 58 in retaining caps 22 are dimensioned to be larger than necks 46 of locking arms 44 but smaller than the areas of the arms at hook portions 50. Therefore, the retaining caps can be snapped onto the locking arms by pushing the arms into the holes during which the arms will compress due to slits 52. Once hook portions 50 pass through the holes, the locking arms will expand or assume their natural condition with hook portions 50 lockingly engaging the forward surfaces of the retaining caps. It can be seen that heads 48 of the locking arms are rounded and pointed for engaging chamfered areas 58*a* of holes 58 in the locking arms to facilitate insertion of the arms into the holes and compression of the arms. It follows that the retaining caps can be removed from their locked position on the locking arms by forcing the heads 48 toward each other. This force should be continued until the arms 44 compress due to slits 52 until the hook portions 50 can back out through holes 58 in the retaining caps 22.

Referring to FIGS. 2–5 in conjunction with FIG. 1, it can be understood that the floating panel mount system described above greatly increases the amount of floating movement between connector 16 and panel 18 than if the flexible locking arms simply passed through given apertures and snappingly engaged the opposite side of the panel. This would require apertures 26 to be made considerably smaller and, consequently, reduce the amount of floating action. With the invention, flexible locking arms 44 freely pass through apertures 26 which are considerably larger in cross-dimensions than the cross-dimensions of the locking arms. However, retaining caps 22 which are locked onto the flexible locking arms are larger than the apertures and prevent the locking arms from pulling back out of the panel. These relative dimensions can be seen best in FIGS. 3–5.

Figure 3:
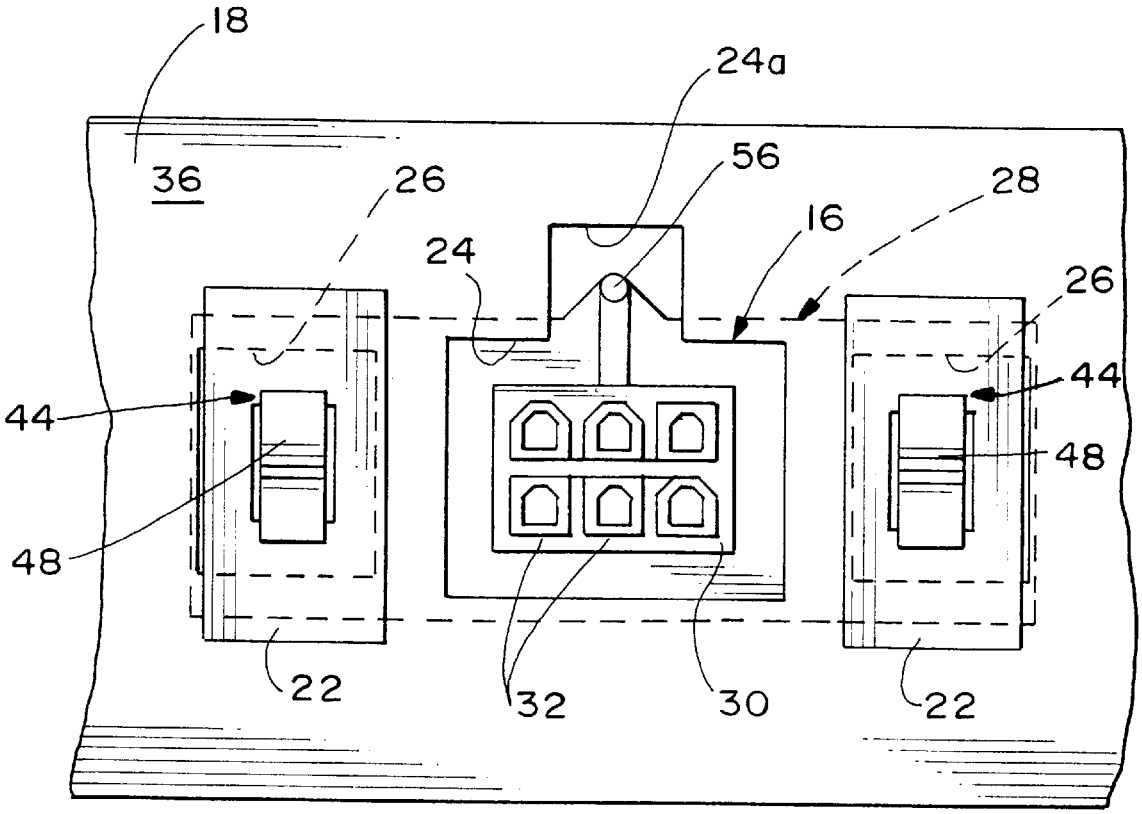
FIG. 3 is a front elevational view of the connector assembly of FIG. 1 mounted to the panel.
Figure 4:
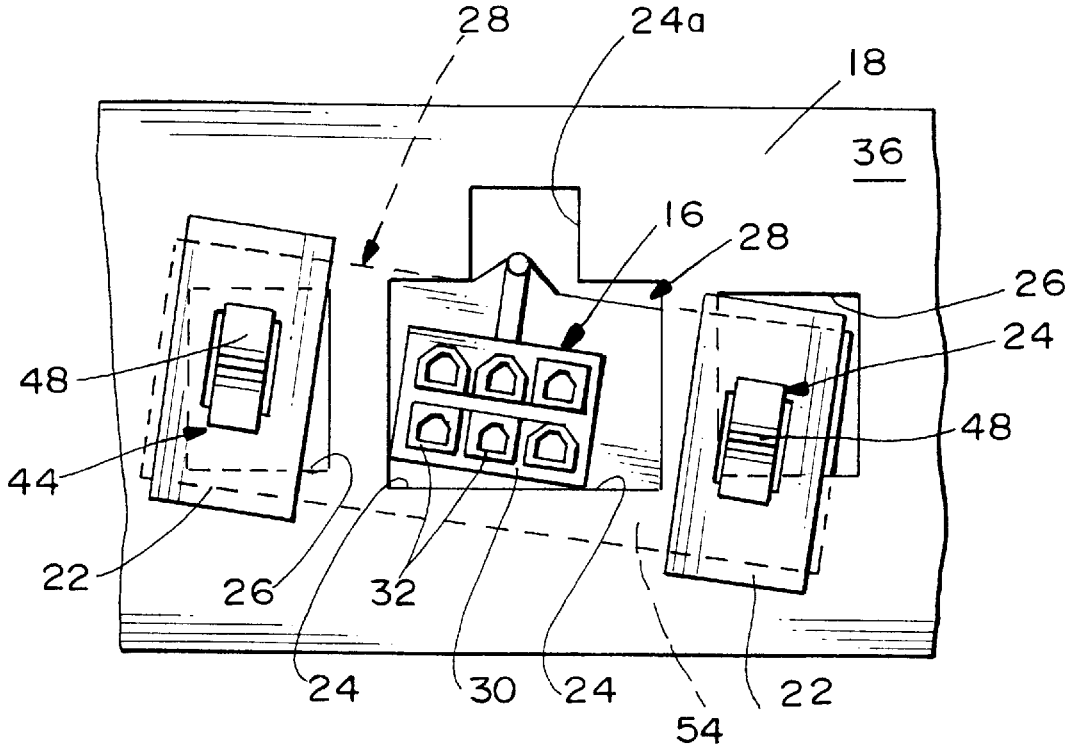
FIGS. 4 and 5 are views similar to that of FIG. 3, but showing ranges of floating movement of the connector assembly relative to the panel.

Specifically, FIG. 3 shows connector 16 and connector housing 28 more or less centered relative to apertures 24 and 26, with fulcrum pin 56 sort of centered in notch portion 24*a* of aperture 24. The fulcrum pin 56 provides polarization to insure that the connector housing is properly oriented in the panel 18. If the pin 56 contacts any part of the panel without the notch portion 24*a*, the connector will be prevented from being inserted in the panel in the incorrect orientation. Retaining caps 22 substantially cover outside apertures 26 and extend laterally of the apertures at the tops and bottoms thereof for engaging front side 36 of panel 18. FIG. 4 shows connector 16 and connector housing 28 angularly tilted a considerable degree relative to panel 18. It can be seen how mating portion 30 of the connector is "cocked" within center aperture 24. Of course, an infinitely wide range of relative angular positions between the connector and the panel are afforded within the confines of the aperture and the outside dimensions of the mating portion.

Figure 5:
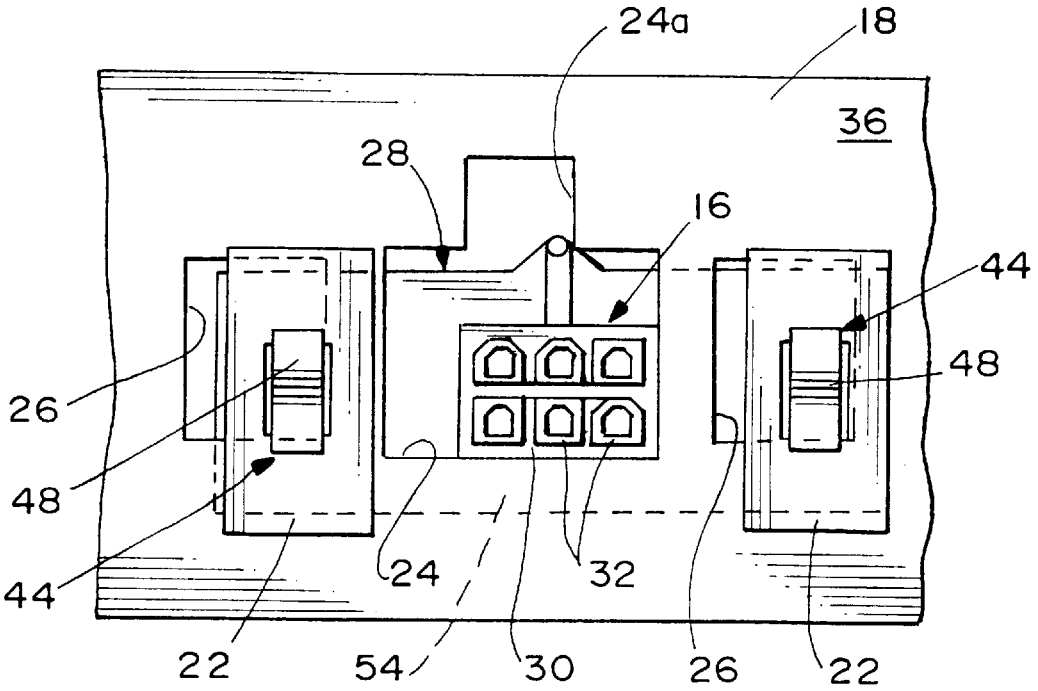

FIG. 5 shows connector 16 and connector housing 28 having "floated" such that mating portion 30 is at the extreme bottom right-hand corner of center aperture 24. Of course, the mating portion can shift in all lateral directions relative to the panel.

From the foregoing, it can be understood that employing retaining caps 32 as an independent means for engaging front side 36 of panel 18, rather than having the locking arms directly engage the panel, a substantial amount of floating action is permitted between connector 16 and the panel. Without retaining caps 22, the head portions of the locking arms would have to be made unacceptably large or the neck portions of the locking arms would have to be made unacceptably small to afford the range of floating action permitted by employing independent retaining caps 22.

Figure 6:
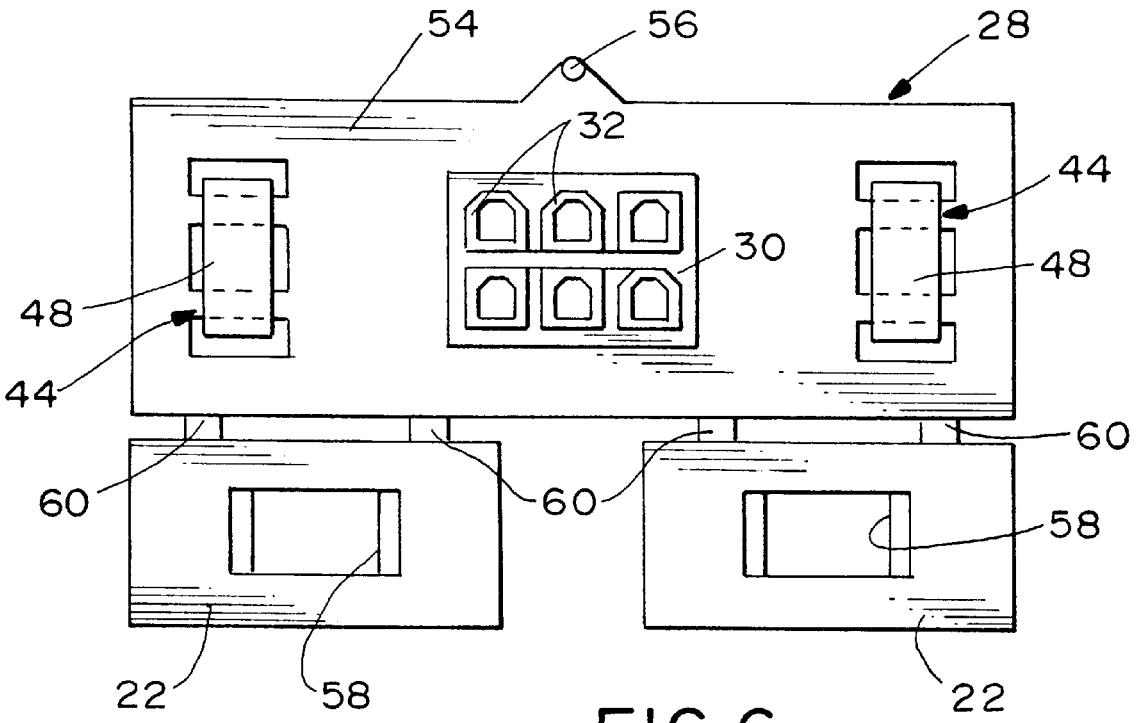
FIG. 6 is a plan view of the connector housing and retaining caps as integrally manufactured but before use.
Figure 7:
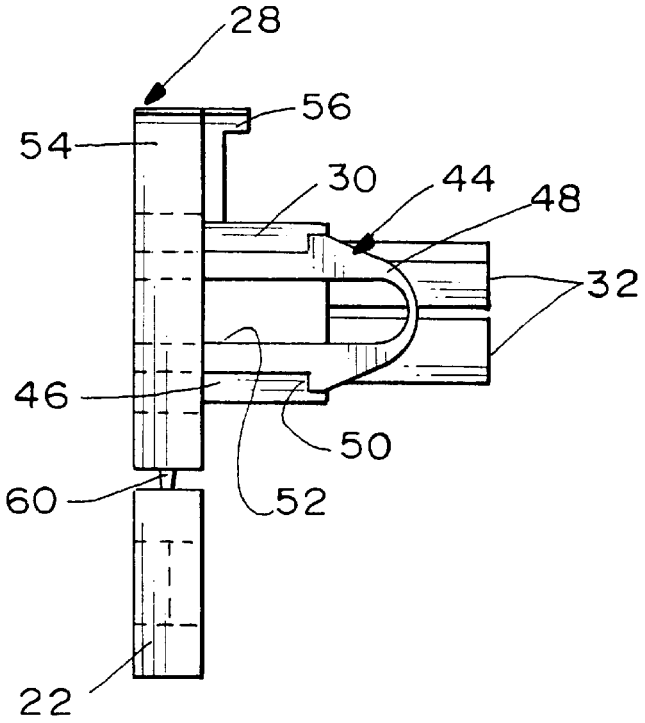
FIG. 7 is an end elevational view looking toward the left-hand end of FIG. 6.

FIGS. 6 and 7 show a means or method of fabricating retaining caps 22 integrally with connector housing 28 during manufacture. As stated above, connector housing 28, including mating portion 30, locking arms 44 and flange portion 54 thereof, is a unitarily molded structure of dielectric material, such as plastic or the like. Retaining caps 22 similarly are unitarily molded and can be joined to flange portion 54 by integral webs 60. During assembly, the retaining caps can be broken away from connector housing 28 simply by breaking webs 60. By this means, the retaining caps are less likely to become misplaced or lost during handling and assembly.

FIGS. 8–10 show a second embodiment of the invention wherein a floating panel mount system, generally designated 61 (FIG. 10) includes a connector housing, generally designated 62. The housing includes a mating portion 30 and silos 32 similar to the mating portion described above in relation to the embodiment of FIGS. 1–7. The connector housing includes a pair of flexible locking arms 64 on diametrically opposite sides of mating portion 30. The connector housing again includes a flange portion 66 adapted to engage a back side 68 (FIG. 10) of a panel 70. Mating portion 30 and flexible locking arms 64 are adapted to pass through a single aperture 72 in the panel.

As seen in FIGS. 8 and 9, the second embodiment includes a single retaining cap 74 having a single hole 76 therein. The cap is joined to connector housing 62 by webs 78 during the molding process. During assembly, the retaining cap is broken away from connector housing 62 by breaking webs 78. Lastly, flexible locking arms 64 have hook portions 80 for snappingly lockingly engaging retaining cap 74 as described below.

During assembly, mating portion 30 (along with silos 32) and flexible locking arms 64 are inserted through enlarged aperture 72 in panel 70 in the direction of arrow "B" (FIG. 10). It can be seen how much larger the cross-dimensions of aperture 52 are in comparison to the connector housing, such that the mating portion and the locking arms of the housing freely pass through the aperture. Therefore, considerable floating action is afforded between the connector and the panel. Once the connector is fully mounted to the panel, retaining cap 74 is assembled over flexible locking arms 64 in the direction of arrow "C". The flexible locking arms will flex or yield inwardly in the direction of arrows "D" whereupon hook portions 80 of the locking arms will snappingly engage the outside surface of the retaining cap. Like the embodiment of FIGS. 1–7, single retaining cap 74 locks the connector to the panel, prevents the mating portion from pulling back out of aperture 72 in the panel, yet permits a wide range of floating motion between the connector and the panel.

Lastly, FIGS. 11–13 show a means by which retaining caps 22 (FIG. 1) can be joined integrally by molded straps 90. This structure allows the retaining caps to always be in pairs and assembled accordingly, reducing the chances of misplacing or losing the caps during handling and/or assembly.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A floating panel mount system for mounting an electrical connector to panel, comprising:

a panel having aperture means therethrough;

a connector housing having mating portion adapted to pass through the aperture means from one side of the panel for mating with a complementary connecting device on the opposite side of the panel and adapted to provide substantial clearance in the aperture means permitting floating motion relative to the panel, a locking portion adapted to pass through the aperture means from said one side of the panel and adapted to provide substantial clearance in the aperture means, and a flange portion adapted to engage said one side of the panel laterally of the aperture means; and a retaining cap lockingly interengageable with the locking portion and having a planar surface engageable with the opposite side of the panel to prevent the mating portion from pulling back out of the aperture means the retaining cap beginning at the planar surface and extending away from the opposite side of the panel.

2. The floating panel mount system of claim 1 wherein said aperture means comprises at least one aperture for passing therethrough of the mating portion and a second aperture for passing therethrough of the locking portion.

3. The floating panel mount system of claim 1 wherein said locking portion comprises a flexible locking arm having a hook portion for locking interengagement with the retaining cap.

4. The floating panel mount system of claim 3 wherein said retaining cap has a hole into which the locking arm snappingly interengages by means of said hook portion.

5. The floating panel mount system of claim 1 wherein said aperture means comprises a single aperture for passing therethrough of both the mating portion and the locking portion.

6. The floating panel mount system of claim 5, including a pair of said locking portions generally on diametrically opposite sides of the mating portion, both locking portions and the mating portion being adapted for passing through the single aperture.

7. The floating panel mount system of claim 1 wherein said housing, including said mating portion, said locking portion and said flange portion thereof, is unitarily molded of dielectric material.

8. A floating panel mount system for mounting an electrical connector to panel, comprising:

a panel having first and second apertures;

a connector housing unitarily molded of dielectric material and having a mating portion adapted to pass through the first aperture from one side of the panel for mating with a complementary connecting device on the opposite side of the panel and adapted to provide substantial clearance in the first aperture permitting floating motion relative to the panel, a flexible locking arm adapted to pass through the second aperture from said one side of the panel and adapted to provide substantial clearance in the second aperture, and a flange portion adapted to engage said one side of the panel laterally of the first and second apertures; and a retaining cap lockingly interengageable with the flexible locking arm and having a planar surface engageable with the opposite side of the panel to prevent the mating portion from pulling back out of the first aperture the retaining cap beginning at the planar surface and extending away from the opposite side of the panel.

9. The floating panel mount system of claim 8 wherein said retaining cap has a hole into which the flexible locking arm is insertable, and the locking arm has a hook portion for snappingly lockingly engaging the retaining cap.

10. A floating panel mount system for mounting an electrical connector to panel, comprising:

a panel having a single aperture therethrough;

a connector housing unitarily molded of dielectric material and having a mating portion adapted to pass through the aperture from one side of the panel for mating with a complementary connecting device on the opposite side of the panel and adapted to provide substantial clearance in the aperture permitting floating motion relative to the panel, a flexible locking arm adapted to pass through the aperture from said one side of the panel and adapted to provide substantial clearance in the aperture, and a flange portion adapted to engage said one side of the panel laterally of the aperture; and a retaining cap lockingly interengageable with the flexible locking arm and having a planar surface engageable with the opposite side of the panel to prevent the mating portion from pulling back out of the single aperture the retaining cap beginning at the planar surface and extending away from the opposite side of the panel.

11. The floating panel mount system of claim 10 wherein said retaining cap has a hole into which the flexible locking arm is insertable, and the locking arm has a hook portion for snappingly lockingly engaging the retaining cap.

12. The floating panel mount system of claim 10, including a pair of said flexible locking arms generally on diametrically opposite sides of the mating portion, both locking arms and the mating portion being adapted for passing through the single aperture.

13. In an electrical connector for mounting to an apertured panel, and for mating with another connecting device moveable relative to the electrical connector in a mating direction along a mating axis generally perpendicular to the panel, said electrical connector including, a housing having a flange portion engageable with a first side of the panel, a mating portion adapted to pass through a first aperture from the first side of the panel and adapted to provide clearance in the first aperture permitting the connector motion relative to the panel, and a locking portion adapted to pass through a second aperture and to provide clearance in the second aperture permitting the connector motion relative to and in a plane generally parallel to the plane of the panel, wherein the improvement comprises:

a retaining cap, separate from the housing, engageable with the locking portion when said locking portion is extended through said second aperture, said retaining cap being engageable with a second side of the panel and having planar dimensions such that at least some portion of the cap overlies the second side regardless of the position of the locking portion in the second aperture and thereby insuring that the connector will not pull out of the second aperture opposite said mating direction whereby said permitted motion relative to the plane of the panel is substantial.

14. In an electrical connector for mounting to an apertured panel, and for mating with another connecting device moveable relative to the electrical connector in a mating direction along a mating axis generally perpendicular to the panel, said electrical connector including, a housing having a flange portion engageable with a first side of the panel, a mating portion adapted to pass through aperture means from the first side of the panel and adapted to provide substantial clearance in the aperture means permitting the connector substantial motion relative to the panel, and a locking portion adapted to pass through said aperture means and to provide substantial clearance in the aperture means permitting the connector substantial motion relative to and in a plane generally parallel to the plane of the panel, wherein the improvement comprises:

a retaining cap, separate from the housing, engageable with the locking portion when said locking portion is extended through said aperture means, said retaining cap having a planar surface engageable with a second side of the panel and having planar dimensions such that at least some portion of the cap overlies the second side regardless of the position of the locking portion in the aperture means and thereby insuring that the connector will not pull out of the aperture means opposite said mating direction, whereby said permitted motion relative to the plane of the panel is substantial the retaining cap beginning at the planar surface and extending away from the opposite side of the panel.

15. In a floating electrical connector for mounting to an apertured panel, and for mating with another connecting device movable relative to the electrical connector in a mating direction along a mating axis generally perpendicular to the panel, said electrical connector including, a housing having a mating portion adapted to pass through aperture means, a flange portion adjacent the mating portion adapted to engage a first side of the panel, and projection means extending from the flange portion through said aperture means permitting connector motion relative to and in a plane generally parallel to panel, and cap means interengageable with the projection means when extending through the aperture means and being of such a size and shape that it cannot pass through said aperture means when engaged with said projection means, wherein the improvement comprising:

said projection means includes two locking portions extending from the flange, and said cap means includes two retaining caps, one for each locking portion.

16. A floating panel mount system for mounting an electrical connector to panel, comprising:

a panel having aperture means therethrough;

a connector housing having a mating portion adapted to pass through the aperture means from one side of the panel for mating with a complementary connecting device on the opposite side of the panel and adapted to provide substantial clearance in the aperture means permitting floating motion relative to the panel, a locking portion adapted to pass through the aperture means from said one side of the panel and adapted to provide substantial clearance in the aperture means, and a flange portion adapted to engage said one side of the panel laterally of the aperture means;

said aperture means comprising at least one aperture for passing therethrough of the mating portion and a second aperture for passing therethrough of the locking portion and a pair of said locking portions generally on diametrically opposite sides of the mating portion, a pair of said second apertures for passing therethrough of the pair of locking portions, and a pair of said retaining caps for locking interengagement with the pair of locking portions; and a retaining cap (22) lockingly interengageable with the locking portion and engageable with the opposite side of the panel to prevent the mating portion from pulling back out of the aperture means.

17. A floating panel mount system for mounting an electrical connector to panel, comprising:

a panel having first aperture and a pair of second apertures;

a connector housing unitarily molded of dielectric material and having a mating portion adapted to pass through the first aperture from one side of the panel for mating with a complementary connecting device on the opposite side of the panel and adapted to provide substantial clearance in the first aperture permitting floating motion relative to the panel, a pair of flexible locking arms generally on diametrically opposite sides of the mating portion adapted to pass through the pair of second apertures from said one side of the panel and adapted to provide substantial clearance in the second aperture, and a flange portion adapted to engage said one side of the panel laterally of the first and second apertures; and a pair of retaining caps lockingly interengageable with the flexible locking arms and engageable with the opposite side of the panel to prevent the mating portion from pulling back out of the first aperture.

* * * * *